US008491425B2

(12) United States Patent
Kessler

(10) Patent No.: US 8,491,425 B2
(45) Date of Patent: Jul. 23, 2013

(54) TRANSPARENT PLAY BALL CONTAINING SHAPES WHICH TEMPORARILY STICK TO INTERIOR WALL OF BALL

(75) Inventor: Brian Kessler, Los Angeles, CA (US)

(73) Assignee: Maui Toys, Inc., Los Angeles, CA (US)

( * ) Notice: Subject to any disclaimer, the term of this patent is extended or adjusted under 35 U.S.C. 154(b) by 27 days.

(21) Appl. No.: 13/286,485

(22) Filed: Nov. 1, 2011

(65) Prior Publication Data

US 2013/0109514 A1 May 2, 2013

(51) Int. Cl.
*A63B 43/00* (2006.01)

(52) U.S. Cl.
USPC ..... 473/594; 473/609

(58) Field of Classification Search
USPC ..... 473/594, 577, 595, 604, 609; 446/220
See application file for complete search history.

(56) References Cited

U.S. PATENT DOCUMENTS

| | | | | |
|---|---|---|---|---|
| 2,219,074 | A * | 10/1940 | Le Guillou | 473/594 |
| 3,980,300 | A * | 9/1976 | Hornsby, Jr. | 473/594 |
| 4,194,737 | A * | 3/1980 | Farmer | 473/570 |
| 4,448,418 | A * | 5/1984 | McNeill | 473/594 |
| 5,698,621 | A * | 12/1997 | Nguyen et al. | 524/297 |
| 5,749,799 | A * | 5/1998 | Jasperson | 473/594 |
| 6,048,591 | A * | 4/2000 | Zwiebel | 446/220 |
| 6,533,637 | B1 * | 3/2003 | Liao | 473/594 |
| 6,645,098 | B1 * | 11/2003 | Quinn | 473/594 |
| 2003/0171173 | A1 * | 9/2003 | Rudzki | 473/569 |
| 2007/0028519 | A1 * | 2/2007 | Seibel et al. | 47/72 |
| 2009/0312127 | A1 * | 12/2009 | Kessler | 473/570 |
| 2010/0184541 | A1 * | 7/2010 | Kessler | 473/570 |

* cited by examiner

*Primary Examiner* — Steven Wong
(74) *Attorney, Agent, or Firm* — Browdy and Neimark, PLLC

(57) ABSTRACT

A transparent polyurethane ball contains polyvinylchloride decorative shapes which cling temporarily to the interior surface of the ball.

15 Claims, 2 Drawing Sheets

TRANSPARENT PLAY BALL CONTAINING SHAPES WHICH TEMPORARILY STICK TO INTERIOR WALL OF BALL

FIELD OF INVENTION

The present invention relates to an amusement device in the nature of an at least partly transparent ball containing decorative shapes which stick temporarily to the inside of the ball, which ball is formed of an elastomeric wall which is clear or near transparent, carrying therewithin such loose decorative shapes which temporarily cling for several seconds at least to the interior wall of the ball when the ball is shaken or the shapes are otherwise caused to move within the ball.

BACKGROUND

Balls are known which are filled under pressure with either liquid or gas, e.g. air, and which have transparent shells and decorative elements therewithin, attention being invited to copending application Ser. No. 12/464,667, filed May 12, 2009, and copending application Ser. No. 12/482,623, filed Jun. 11, 2009.

SUMMARY OF INVENTION

The present invention relates to a transparent or at least partially transparent or semi-transparent ball, preferably but not necessarily a single-layer of spherical shape, filled with gas under pressure, preferably air, and containing a plurality of decorative small shapes, desirably of a size greater than the size of reflective "glitter" particles, and which are unconnected to the interior of the hall, but which stick or adhere temporarily to the interior of the ball when the ball is shaken or thrown, thereby giving a different pattern of clinging shapes each time the ball is shaken or thrown.

DETAILED DESCRIPTION OF INVENTION

Figure 1:
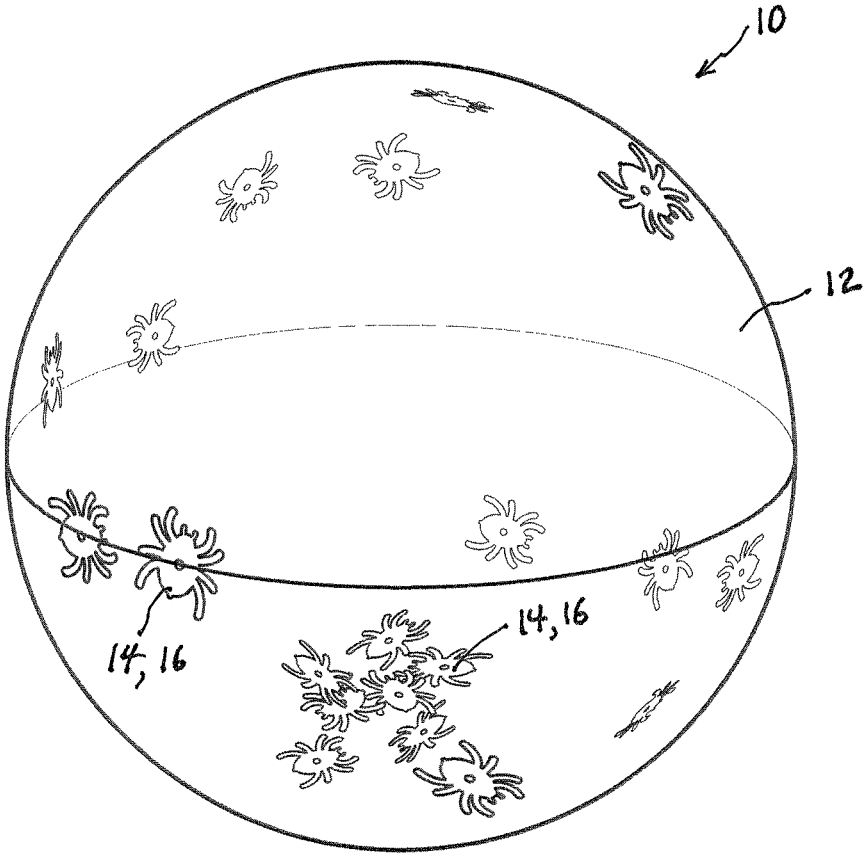
FIG. 1 shows the ball containing small shapes, in this case spider shapes, with a few of such shapes clinging to the inside surface of the ball, with other such shapes not sticking and accumulating at the bottom of the ball.
Figure 2:
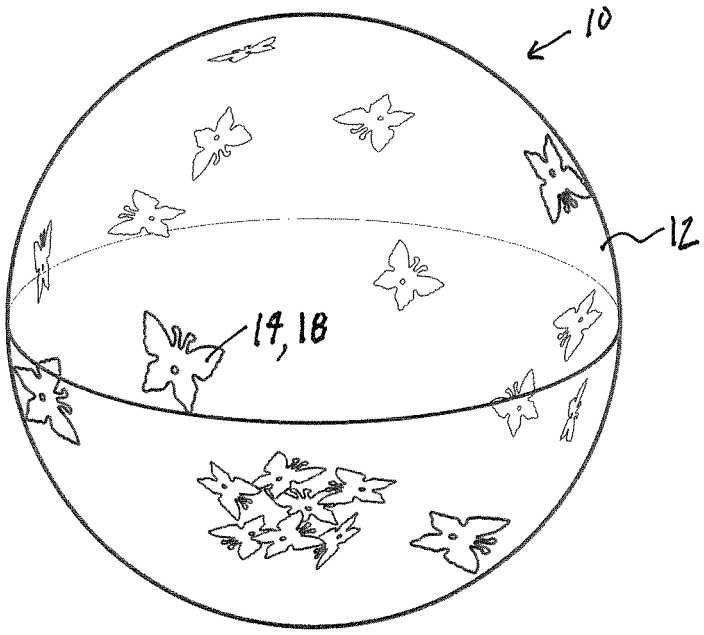
FIG. 2 shows another perspective view, similar to FIG. 1, showing some clinging shapes in the shape of a butterfly, sticking to the inside wall of the ball.

FIG. 1 shows a spherical ball 10 in accordance with the present invention having a single-layer shell or wall 12 formed of an elastomer and which is both sufficiently transparent so that what is within the ball can be seen, and which has good bounce characteristics. In accordance with the present invention, the ball is desirably formed of an MDI-based polyurethane (PU), more particularly a methylene diphenyl diisocyanate based (MDI-based) polyurethane elastomer. For example, the composition of the polyurethane may include isocyanate, polyol, and/or a chain extender. The isocyanate may be a MDI type constituting 25 wt % of the polyurethane. The polyol may be a polyester and/or polyether type polyol with at least two functional OH groups on a molecular chain of the polyol, and the polyol may constitute 70 wt % of the polyurethane and have a molecular weight (MW) from 1,000-10,000 daltons. The chain extender may have at least two functional OH groups or at least two $NH_2$ functional groups, it may constitute 5 wt % of the polyurethane, and it may have short chain molecules with MW50-800 daltons. As a result, the polyurethane may have a density of 1.1-1.2 g/cm$^3$, and a hardness of 70 A-90 A (A means hardness as measured by a Shore A Durometer).

In one embodiment, a spherical shell 12 is formed of solid, elastomer polyurethane having a wall thickness of 3-5 mm, capable of withstanding a temperature of 200-300° C., and have a diameter of approximately 9.2 cm. The ball 10 is injected with a gas, preferably air, under high inflation pressure of 0.5-0.8 kfg/cm$^2$, preferably greater than 0.65 kfg/cm$^2$.

With respect to the wall or shell 12 thickness, it has been found that walls of a thickness less than 3 mm are unsatisfactory for purposes of reliability, and that wall thicknesses of 3-5 mm are optimal. Walls more than 5 mm thick add unnecessary weight, and also adversely affect the bounce properties as well as the overall cost. Wall thicknesses less than 3 mm do not permit sufficiently high inflation pressures which contribute to the high bounce capabilities of the ball, and can break open prematurely.

Selection of an appropriate shell material is of particular importance for the purposes of the present invention including temporary clinging of the shapes to the interior of the ball, in combination with the material of the shapes themselves as noted below. However, a soft, plasticized, highly elastic, polyester based, solid, thermoplastic polyurethane (PU) resin, which is non-toxic, colorless and transparent, has been found suitable. As noted above, such polyurethane is a methylene diphenyl diisocyanate (MDI) reaction product with a polyol formed from about 25 wt % of the MDI and about 70 wt % of a polyol having at least two functional OH groups and a molecular weight of from 1000 to 10,000, together with about 5 wt % of a chain extender having a molecular weight of about 50 to about 800, the chain extender having at least two functional OH groups or at least two $NH_2$ functional groups. The resultant highly elastic, solid, thermoplastic polyurethane resin has density of about 1.1 to about 1.2 g/cm$^3$, preferably about 1.1 g/cm$^3$, a melting point of 220° C. and a Shore A hardness of about 70 to about 90.

Particularly suitable is such a polyester based thermoplastic polyurethane resin (TPU) sold under the trademark Estane® 58070 by Lubrizol Advanced Materials, Inc. of Cleveland, Ohio. Estane® 58070 has a Shore A hardness of 72, a specific gravity or density of 1.17, a tensile strength of 45 MPa, an ultimate elongation of 700%, a tensile stress at 100% elongation of 4 MPa, a tensile stress at 300% elongation of 6 MPa, a Graves tear strength of 7.9 kg/mm, and a glass transition temperature $T_g$ of −52° C.

The ball 10 contains a gas under pressure, preferably air, and may contain so-called "glitter" small reflective particles of brightly colored material. However, the present invention is characterized by the inclusion therewithin of decorative particles 14 of substantially larger size than glitter.

More particularly, the larger size particles 14 having decorative shapes and which temporarily cling to the inner surface of the polyurethane shell are formed of polyvinyl chloride (PVC), each shape having a surface area of 0.3-0.7 square inches, such a size being effective for optimum clinging of the shapes to the inside surface of the polyurethane shell. The clingable shapes come desirably cut from polyvinyl chloride film, and have a thickness between 0.005 and 0.015 inches, preferably approximately 0.010 inches. The PVC shapes 14 stick well temporarily to the inside PU material of the shell of the ball.

A single type of clingable shape 14 may be present in a ball 10, or different shapes may be present in a single ball. Similarly, the clingable shapes 14 may be of a single color, or of different colors. In one example, all the shapes are of black spiders 16. In another embodiment, the shapes are butterflies 18 of different colors, e.g. pink, white, green and blue. The shapes and colors permissible according to the present invention are very great, subject to the conditions set forth above as to materials and size of the shapes.

What is meant by "clinging" or "sticking" according to the present invention is that 20-80% of the overall surface area of the shape must be in contact with the interior of the shell of the ball in order for the shape to cling to it. Particulate materials have been placed in balls in the past, but the temporary clinging or sticking of shapes is new, and is believed to be in part dependent on such shapes being of the aforementioned size and the aforementioned material of PVC, as well as the shell of the ball being formed of the aforementioned polyurethane.

The number of clingable shapes 14 within the ball 10 is subject to wide variability, and to an extent depends on the size of the ball. For a ball of about 4-5 inches in diameter, 10 to 20 of such shapes 14 have been found adequate to give the desired clinging effect of at least 2 or 3 of the shapes for at least several seconds.

The foregoing description of the specific embodiments will so fully reveal the general nature of the invention that others can, by applying current knowledge, readily modify and/or adapt for various applications such specific embodiments without undue experimentation and without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. The means, materials, and steps for carrying out various disclosed functions may take a variety of alternative forms without departing from the invention.

Thus the expressions "means to . . . " and "means for . . . ", or any method step language, as may be found in the specification above and/or in the claims below, followed by a functional statement, are intended to define and cover whatever structural, physical, chemical or electrical element or structure, or whatever method step, which may now or in the future exist which carries out the recited function, whether or not precisely equivalent to the embodiment or embodiments disclosed in the specification above, i.e., other means or steps for carrying out the same functions can be used; and it is intended that such expressions be given their broadest interpretation.

What is claimed is:

1. A play ball comprising a shell of at least partly clear or near transparent MDI-based polyurethane, and containing gas under pressure; and a plurality of decorative shapes loose within and unconnected to the polyurethane shell, each shape comprising polyvinyl chloride, having a surface area of 0.3-0.7 square inches and a thickness of 0.005-0.015 inches, said MDI-based polyurethane being adapted to and capable of causing the shapes of polyvinyl chloride to cling thereto, whereby at least a few of said shapes stick, adhere or cling to the interior of the shell temporarily for at least several seconds before falling from the interior of the shell.

2. The ball of claim 1 further containing particles of glitter.

3. The ball of claim 1 having a diameter of 4-5 inches and containing 10-20 of said shapes.

4. The ball of claim 1 wherein said shapes are in the form of spider shapes or butterfly shapes.

5. The ball of claim 2 having a diameter of 4-5 inches and containing 10-20 of said shapes.

6. The ball of claim 5 wherein said shapes are in the form of spider shapes or butterfly shapes.

7. The ball of claim 1 wherein said decorative shapes are at least two different colors.

8. The ball of claim 1 wherein said MDI-based polyurethane comprises a polyol of a polyester and/or polyether with at least two functional OH groups and having a molecular height of from 1,000 to 10,000 daltons.

9. The ball of claim 1 wherein said shell is capable of withstanding a temperature of 200-300° C. and said gas under pressure is at an inflation pressure of 0.5-0.8 kfg/cm$^2$.

10. The ball of claim 1 wherein said shell has a wall thickness of 3-5 mm.

11. The play ball of claim 1 having a spherical shape.

12. The play ball of claim 1 wherein said MDI-based polyurethane is an elastomer.

13. The ball of claim 8 wherein said polyurethane further comprises a chain extender having a molecular weight of about 50 to about 800, the chain extender having at least two functional OH groups or at least two $NH_2$ functional groups.

14. The ball of claim 8 having a melting point of 220° C. and a shore A hardness of about 70 to about 90.

15. The ball of claim 1 wherein said shell has a shore A hardness of 72, a specific gravity or density of 1.17, and tensile strength of 45 MPa, an ultimate elongation of 700%, a tensile stress at 100% elongation of 4 MPa, a tensile stress at 300% elongation of 6 MPa, a Graves tear strength of 7.9 kg/mm, and a glass transition temperature $T_g$ of minus 52° C.

* * * * *